US011097826B1

(12) United States Patent
Dannenberg et al.

(10) Patent No.: US 11,097,826 B1
(45) Date of Patent: Aug. 24, 2021

(54) TILLER FOR OUTBOARD MARINE DRIVE HAVING LANYARD ERROR ALERT

(71) Applicant: Brunswick Corporation, Mettawa, IL (US)

(72) Inventors: Todd Dannenberg, Fond du Lac, WI (US); Rob Podell, Slinger, WI (US)

(73) Assignee: Brunswick Corporation, Mettawa, IL (US)

( * ) Notice: Subject to any disclaimer, the term of this patent is extended or adjusted under 35 U.S.C. 154(b) by 18 days.

(21) Appl. No.: 16/514,575

(22) Filed: Jul. 17, 2019

(51) Int. Cl.
*B63H 20/00* (2006.01)
*B63H 21/21* (2006.01)
*B63H 20/12* (2006.01)

(52) U.S. Cl.
CPC ..... *B63H 21/265* (2013.01); *B63H 20/12* (2013.01); *B63H 21/213* (2013.01)

(58) Field of Classification Search
CPC ..... B63H 20/12; B63H 21/21; B63H 21/213; B63H 2021/216; B63H 21/265; B63B 2017/0009; H01H 27/00; B60K 28/00; B60K 2028/003; B60K 2028/006; B60R 25/00; B60R 25/10; Y10T 74/20232
See application file for complete search history.

(56) References Cited

U.S. PATENT DOCUMENTS 4,762,968 A * 8/1988 Hilton ..... B60K 28/04 200/52 R
4,839,478 A * 6/1989 Howard ..... H01H 3/0226 200/52 R
4,898,132 A * 2/1990 Kanno ..... F02N 11/101 123/179.3
5,144,300 A * 9/1992 Kanno ..... F02N 11/101 123/198 DC
6,352,045 B1 * 3/2002 Takashima ..... B60R 25/24 114/55.5
6,884,130 B2 * 4/2005 Okabe ..... B63H 20/08 440/1
7,026,912 B2 * 4/2006 Suzuki ..... B63C 9/0005 180/272
7,976,354 B2 * 7/2011 Kubota ..... B63H 20/007 440/87
9,764,813 B1 9/2017 Zarembka et al.
9,783,278 B1 10/2017 Dannenberg et al.
9,789,945 B1 10/2017 Vaninetti et al.
10,062,529 B2 * 8/2018 Barker ..... B63C 9/0005

FOREIGN PATENT DOCUMENTS

JP 10250688 A * 9/1998

* cited by examiner

*Primary Examiner* — Ajay Vasudeva
(74) *Attorney, Agent, or Firm* — Andrus Intellectual Property Law, LLP

(57) ABSTRACT

A tiller for an outboard marine drive includes a tiller body that is elongated along a tiller axis between a fixed end connected to an outboard marine drive and a distal end. A lanyard switch on the tiller body is configured to prevent operation of the outboard marine drive when a lanyard clip is not attached to the lanyard switch. A controller is configured to identify that an operator has provided user input to start the outboard marine drive and that the lanyard clip is not connected to the lanyard switch. The controller then generates a lanyard error alert identifying that the lanyard clip is not connected to the lanyard switch.

17 Claims, 6 Drawing Sheets

TILLER FOR OUTBOARD MARINE DRIVE HAVING LANYARD ERROR ALERT

FIELD

The present disclosure generally relates to outboard marine drives, and particularly to tillers for outboard marine drives.

BACKGROUND

The following U.S. Patents are incorporated herein by reference, in entirety:

U.S. Pat. No. 9,783,278 discloses a tiller comprising a supporting chassis having a first end and an opposite, second end. A rotatable throttle grip is supported on the first end and a pivot joint is located at the second end. The pivot joint is configured to facilitate pivoting of the tiller at least into and between a horizontal position wherein the supporting chassis extends horizontally and a vertical position wherein the supporting chassis extends vertically. A top cover is located on the supporting chassis. The top cover and the supporting chassis together define an interior of the tiller. The top cover is located vertically on top of the supporting chassis when the tiller is in the horizontal position U.S. Pat. No. 9,764,813 discloses a tiller comprising a tiller body that is elongated along a tiller axis between a fixed end and a free end. A throttle grip is disposed on the free end. The throttle grip is rotatable through a first (left handed) range of motion from an idle position in which the outboard motor is controlled at idle speed to first (left handed) wide open throttle position in which the outboard motor is controlled at wide open throttle speed and alternately through a second (right handed) range of motion from the idle position to a second (right handed) wide open throttle position in which the outboard motor is controlled at wide open throttle speed.

U.S. Pat. No. 9,789,945 discloses a tiller that has a base bracket that is configured to be rotationally fixed with respect to the outboard motor, a chassis bracket that is coupled to the base bracket, and a locking arrangement. The locking arrangement is movable into and between a locked position, wherein the chassis bracket is locked to and rotates together with the base bracket, and an unlocked position, wherein the chassis bracket is freely rotatable with respect to the base bracket about a vertical axis when the tiller is in a horizontal position.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a tiller for an outboard marine drive includes a tiller body that is elongated along a tiller axis between a fixed end connected to an outboard marine drive and a distal end. A lanyard switch on the tiller body is configured to prevent operation of the outboard marine drive when a lanyard clip is not attached to the lanyard switch. A controller is configured to identify that an operator has provided user input to start the outboard marine drive and that the lanyard clip is not connected to the lanyard switch. The controller then generates a lanyard error alert identifying that the lanyard clip is not connected to the lanyard switch.

In one embodiment of a method of controlling a tiller for an outboard marine drive includes generating a lanyard fault, wherein the lanyard fault indicates that a lanyard clip is not attached to a lanyard switch, and then detecting a user input at the tiller to start the outboard marine drive. At a controller, disconnection of the lanyard clip from the lanyard switch is identified based on the lanyard fault, and then a display on the tiller is controlled to illuminate a lanyard error icon to alert an operator that the lanyard clip is not connected to the lanyard switch.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
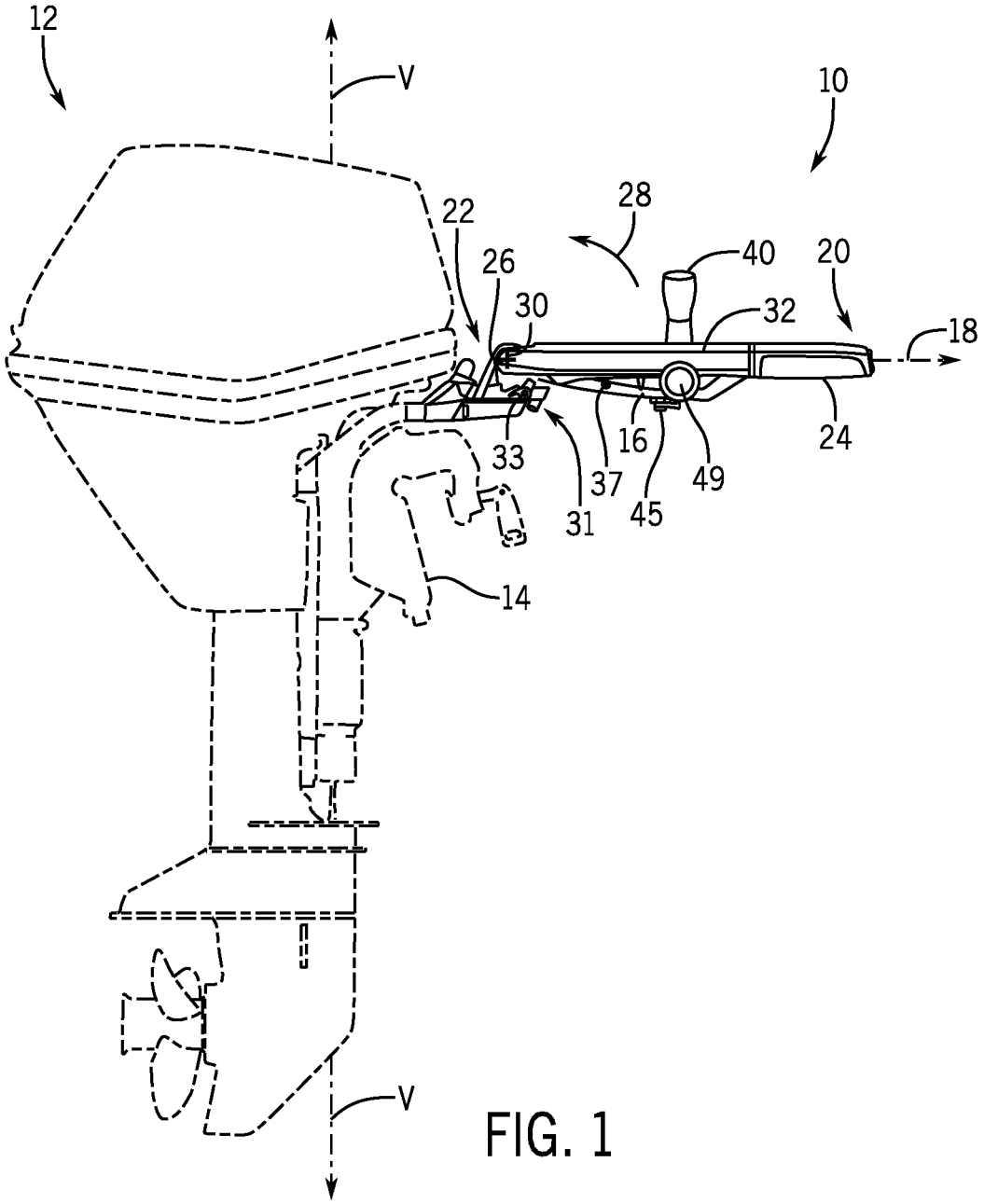
FIG. 1 is a side view of an outboard marine drive and a tiller according to one embodiment of the present disclosure.

FIG. 1 depicts a tiller 10 for use with an outboard marine drive 12, which is illustrated in dashed lines. In the illustrated example, the outboard marine drive 12 is configured for attachment to the transom of a marine vessel via a transom bracket 14, such that the outboard marine drive 12 is steerable about a vertical steering axis V, as is conventional. The configuration of the outboard marine drive 12 is exemplary and can vary from what is shown.

The tiller 10 connects to the outboard marine drive 12 and facilitates throttle and steering control thereof. The tiller 10 has a supporting chassis 16 that extends in an axial direction along a tiller axis 18. The supporting chassis 16 has a first axial end 20 and an axially opposite, second axial end 22. In certain examples, the supporting chassis 16 is made of metal. A rotatable throttle grip 24 is supported on the first axial end 20, which is distal from the outboard. A pivot joint 26 is located at the second axial end 22, which is the end connected to the outboard marine drive 12, and is configured to facilitate pivoting of the tiller 10 through a range of motion 28 including at least into and between a horizontal position where in the supporting chassis 16 extends horizontally (i.e., perpendicular to the vertical steering axis V) and a vertical position where in the supporting chassis 16 extends vertically. The type and configuration of pivot joint 26 can vary from what is shown. As is conventional, the pivot joint 26 allows for pivoting of the tiller 10 through the range of motion 28 about a horizontal pivot axis 30. A bolt 31 and ratchet lever 33 are located at the pivot joint 26 and facilitate positional and pivoting movement, as is conventional.

Figure 2:
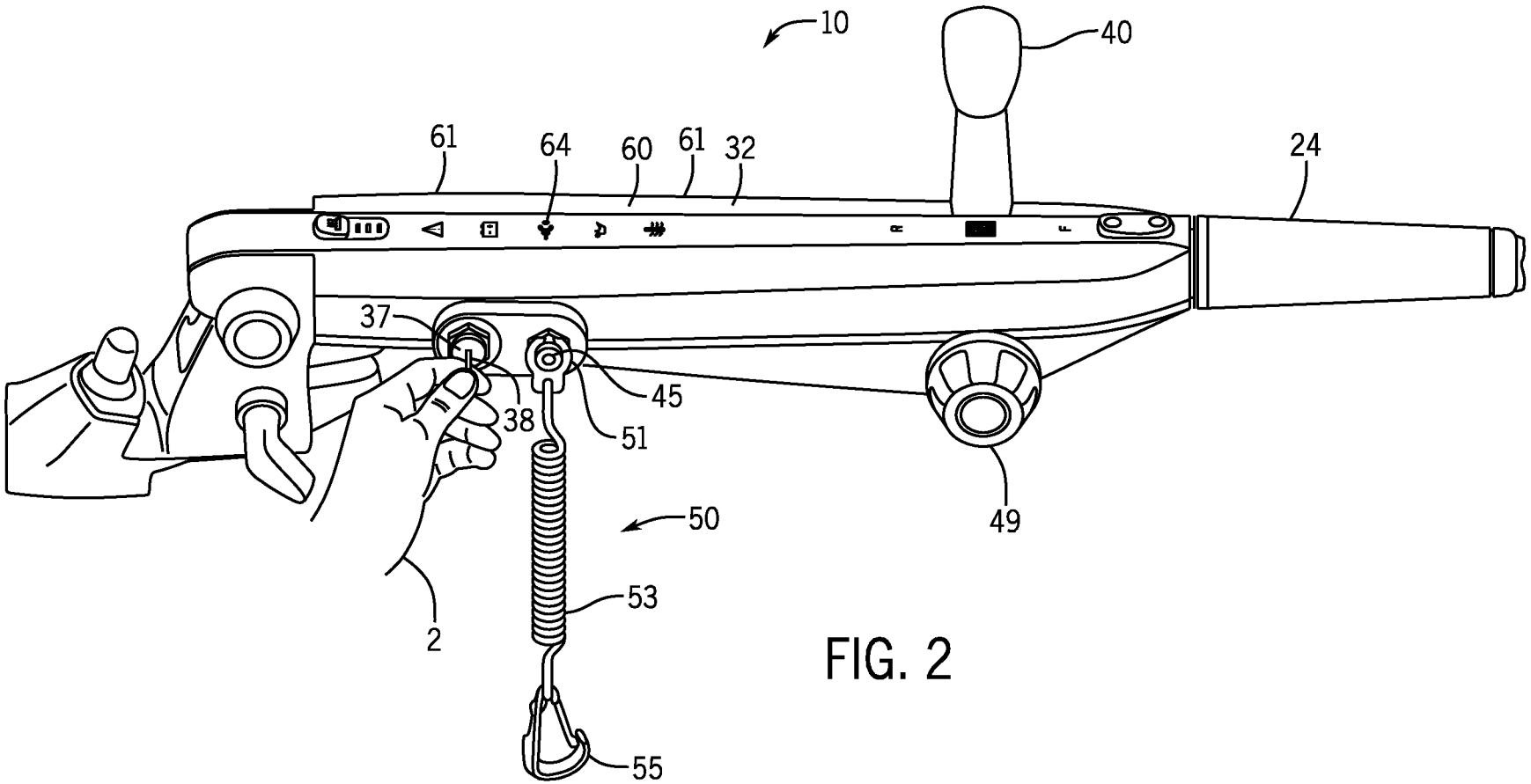
FIG. 2 is a perspective view of a tiller in a horizontal position having a display according to one embodiment of the disclosure and showing a lanyard attached thereto.

A top cover 32 is disposed on top of the supporting chassis 16. The top cover 32 and supporting chassis 16 together define an interior of the tiller 10. The top cover 32 is particularly located on top of the supporting chassis 16 when the tiller 10 is in the horizontal position (FIG. 2). Advantageously, the top cover 32 is removable from the supporting chassis 16 when the tiller 10 is in the horizontal position.

Rotation of the rotatable throttle grip 24 causes rotation of the throttle shaft within the tiller 10, which runs parallel to the tiller axis 18. The throttle shaft (not shown) is connected via a pulley or linkage system to the throttle of the outboard marine drive 12, and thus rotation of the throttle grip 24 is translated to the outboard throttle. A rotatable locking knob 49 is coupled to the mounting sleeve. Rotation of a locking knob 49 in one direction squeezes the mounting sleeve to lock the position of the throttle shaft and rotatable throttle grip 24, thus facilitating hands-free operation. Opposite rotation of the locking knob 49 relaxes the mounting sleeve and thus allows manual rotation of the rotatable throttle grip 24 and associated throttle shaft.

A manual shift lever 40 is coupled to the supporting chassis 16. A shift linkage 42 links the manual shift lever 40 to a transmission (not shown) on the outboard 12. Manual shifting of the shift lever 40 causes corresponding rotation of the shift linkages, which causes corresponding shifting action in the transmission of the outboard marine drive 12, as is conventional.

A user controls the start and stop, on and off, of the outboard marine drive via a start switch 37. In the embodiment of FIG. 2, a key 38 is inserted into the start switch 37 and turned in order to instruct start of the outboard marine drive 12. Such a start configuration is conventional. In other well-known embodiments, a push-button user input mechanism is provided by which a user may instruct start of the outboard 12. The tiller 10 further includes a lanyard switch 45, or a kill switch, and associated circuitry for shutting off the outboard motor in an emergency. The lanyard switch 45 is actuated by a conventional removable lanyard 50, and may be located at various positions on the housing of the tiller 10. FIGS. 1 and 2 illustrate two different exemplarily locations for the lanyard switch 45, but a person having ordinary skill in the art will recognize in light of this disclosure that the lanyard switch may be located elsewhere on the tiller 10. As is conventional, tiller systems 10 are configured such that they do not start unless the lanyard 50 is attached to the lanyard switch 45.

However, the inventors have recognized that lanyard switches, or kill switches, can be problematic from a usability standpoint. For some tillers, the engine may start to rotate even with the lanyard clip is not connected, such as in response to the user turning the key 38. However, the engine of the outboard marine drive 12 will not actually fully start when a lanyard 50 is not connected. The inventors have recognized that this behavior of the marine drive 12 when the lanyard clip is not detected may be similar to the behavior of the drive when it malfunctions, and that users may be (and have been) confused into mistaking the disconnected lanyard situation with a problem with the marine drive 12. Namely, users may not recognize that the failure to start is caused by the disconnected lanyard 50, and may instead believe that there is a problem with the outboard 12. For example, through their experience in the relevant field, the inventors have recognized that service appointments have been made by operators who failed to recognize that the inability to start the marine drive 12 is due to a detached lanyard.

The inventors have further recognized that systems should be developed to promote a safety protocol of lanyard utilization, and that the use of a lanyard should be enforced. Accordingly, lanyards need to be user friendly and avoid inducing user confusion. In view of their recognition of the foregoing problems, the inventors developed the disclosed system that generates a lanyard error warning identifying when a lanyard clip is not connected to a lanyard switch. Thus, when an operator is trying to start the marine drive and the lanyard 50 is not detected, a lanyard error alert will be generated to notify the user that the start failure is caused by the detachment of the lanyard clip 51 from the lanyard switch. In various embodiments, the error warning may include a visual alert and/or an auditory alert.

FIG. 2 depicts one embodiment where a display 60 is provided on the tiller 10. In the depicted embodiment, the display 60 is along a top portion of the tiller 10, and more particularly on a top side of the top cover 32. In other embodiments, the display 60 may be elsewhere on the tiller 10, such as on a side portion of the top cover 32 toward the start switch 37 and the lanyard switch 45. The display 60 may be provided elsewhere on the tiller 10 so long as it is visible by the operator 2 when starting the marine drive 12.

In the depicted embodiment, the display 60 is an illuminable, deadface display providing various error icons, or warning lights, to indicate system errors or faults relating to the marine drive 12 and/or to the tiller 10. For example, the display 60 may include one or more light sources 66, such as LEDs (FIG. 5), associated with each error icon 61 provided on the display 60. The light sources may be separately illuminable in order to separately control illumination of each error icon 61. In other embodiments, the display 60 may be another type of display device, such as a digital display.

Figure 3A:
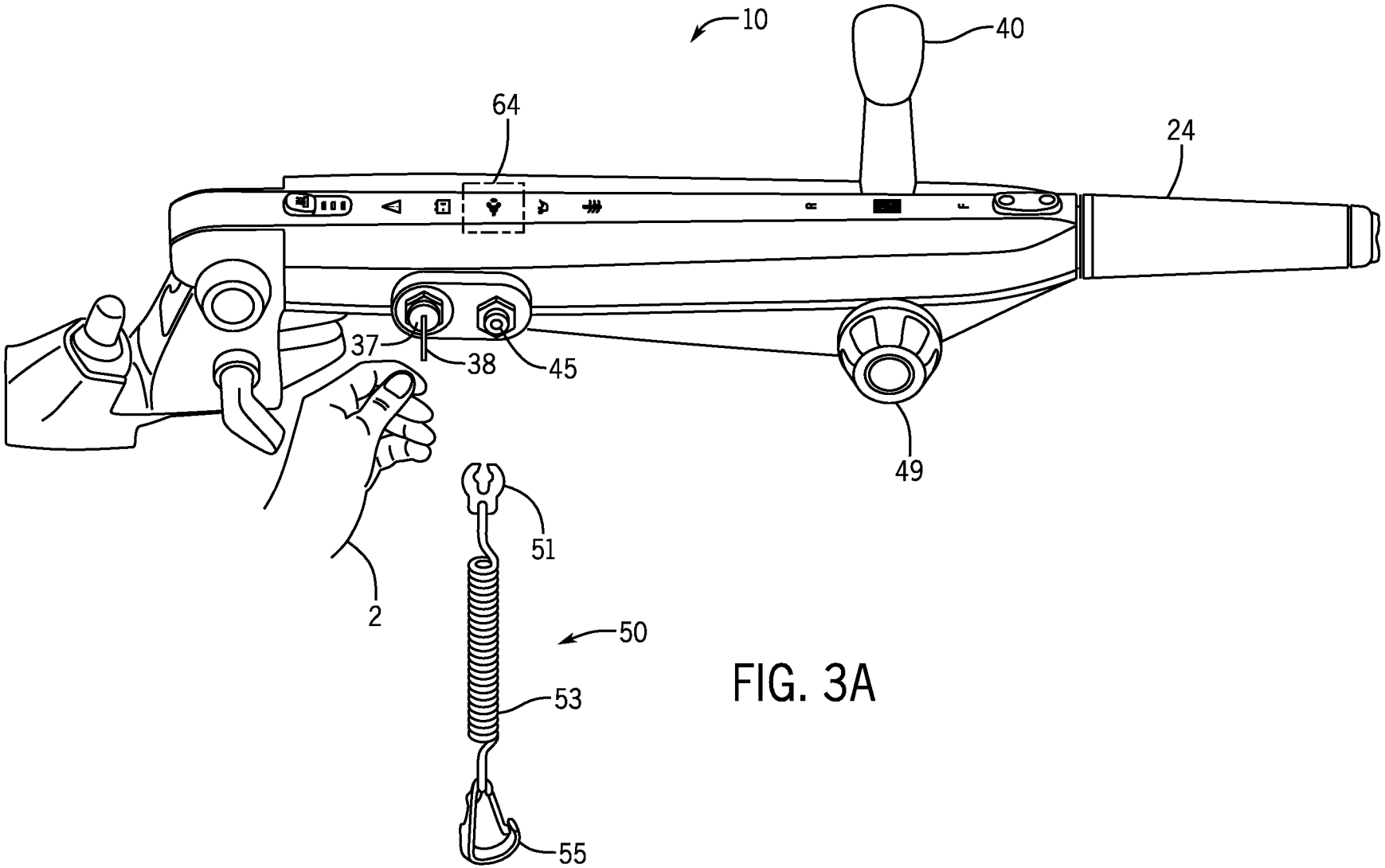
FIGS. 3A-3C show a perspective view of the tiller illustrating a display showing a lanyard error warning when the lanyard is detached.

The error icons 61 provided on the display include a lanyard error icon 64 illuminable to indicate to a user that the lanyard 50 is not connected, or at least that the lanyard clip 51 is not fully connected to the lanyard switch 45. FIGS. 2 and 3A depict an exemplary lanyard 50 having a lanyard strap 53 with a lanyard clip 51 on one end and a user connection end 55 at the other. The lanyard clip 51 is configured to connect to the lanyard switch 45—which is shown connected in FIG. 2 and disconnected in FIG. 3A. In one embodiment, connection of the lanyard clip 51 closes a power circuit powering a starter of the marine drive 12. Thus, the marine drive 12 will not start when the lanyard clip 51 is not fully engaged with the lanyard switch 45. Alternatively or additionally, a sensor 46 may be associated with the lanyard switch 45 that generates an error, such as on a CAN bus 75, to a controller 70, such as an engine control unit (ECU) (see FIG. 5). The controller 70 may be situated within the tiller 10, as depicted in the system diagram of FIG. 5. In other embodiments, the controller 70 may be situated within the outboard 12, such as within the cowl or other housing portion of the outboard marine drive 12.

Figure 5:
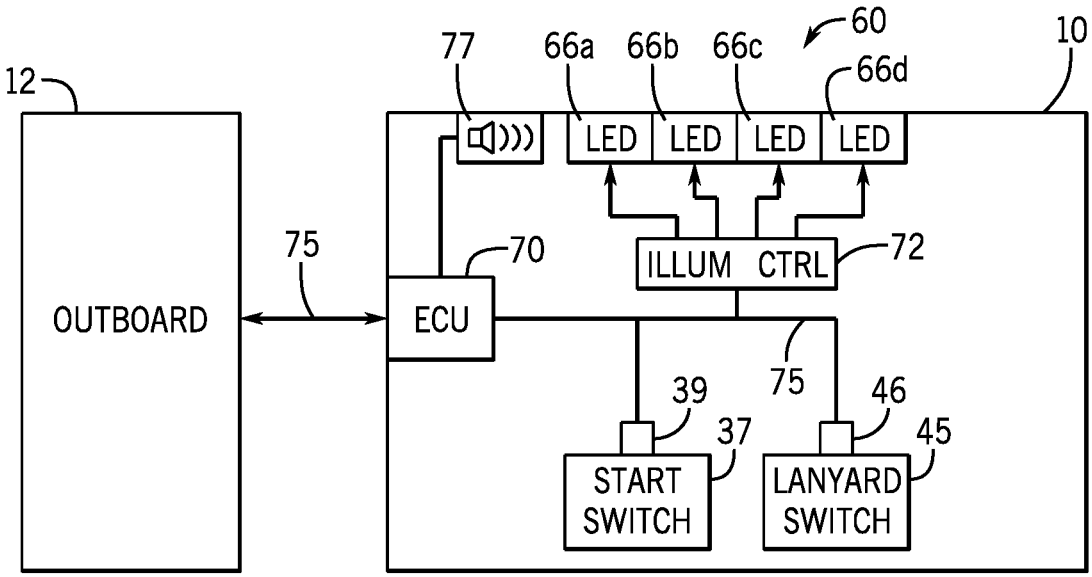
FIG. 5 is a schematic depiction of a tiller system according to one embodiment of the disclosure.

In the example shown in FIG. 5, the sensor 46 senses when the clip 51 is not attached to the lanyard switch 45, and communicates a lanyard fault via the CAN bus 75. The lanyard fault is received at the controller 70. The controller 70 may comprise logic to determine whether to illuminate the lanyard error icon 64. For example, if the start switch 37 is closed, such as the key 38 is inserted, then the controller 70 may be configured to illuminate the lanyard error icon 64 to alert a user to connect the lanyard 50. Alternatively or additionally, the controller 70 may only illuminate the lanyard error icon 64 after receiving user input instructing start of the outboard marine drive, such as when the user turns the key 38. In one embodiment, the lanyard error icon 64 may be illuminated differently before and after the start input is received. For example, the lanyard error icon 64 may be illuminated when the key 38 is inserted in the start switch 37 but the lanyard 50 is not attached. Illumination of the lanyard error icon 64 may then be changed following receipt of user input from the operator instructing start of the marine drive, such as the operator turning the key 38. For example, the lanyard error icon 64 may flash to draw the user's attention to the visual lanyard error warning.

Alternatively or additionally, an auditory warning may be generated, such as via a speaker or other noise-generating device that can generate an auditory lanyard error alert. For example, a speaker 77 may be incorporated in the tiller 10 and controlled to generate an alarm, beep, buzz, or the like. Alternatively, the noise-generating element 77 may be a piezoelectric buzzer or other simple noise-generating element controllable to generate an auditory error alert to bring the operator's attention to the fact that the lanyard 50 is not attached to the tiller 10. The auditory lanyard error alert may be used in conjunction with the visual error alert, e.g., provided by the lanyard error icon 64, in order to communicate the lanyard error warning to the operator 2.

In one embodiment, the controller 70 communicates an instruction to illuminate an error icon via the CAN bus 75, and the instruction is received at an illumination controller 72. The illumination controller 72 then illuminates the respective LED(s) 66*a*-66*d* associated with the instructed error icon 61. Thus, when the lanyard clip 51 is not connected to the lanyard switch 45, the controller 70 detects a fault condition and sends a requisite control instruction in order to illuminate the lanyard error icon 64 accordingly.

Figure 3B:
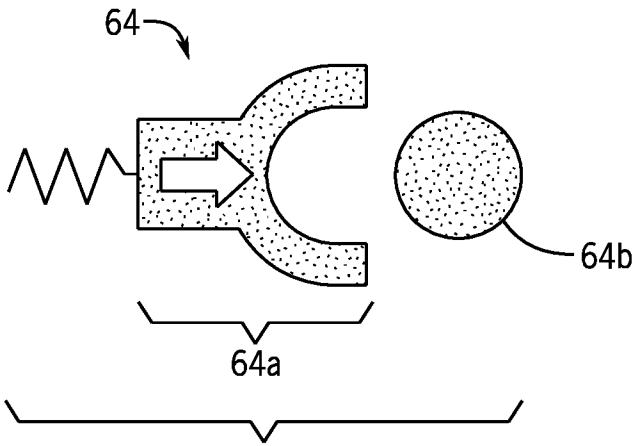
Figure 3C:
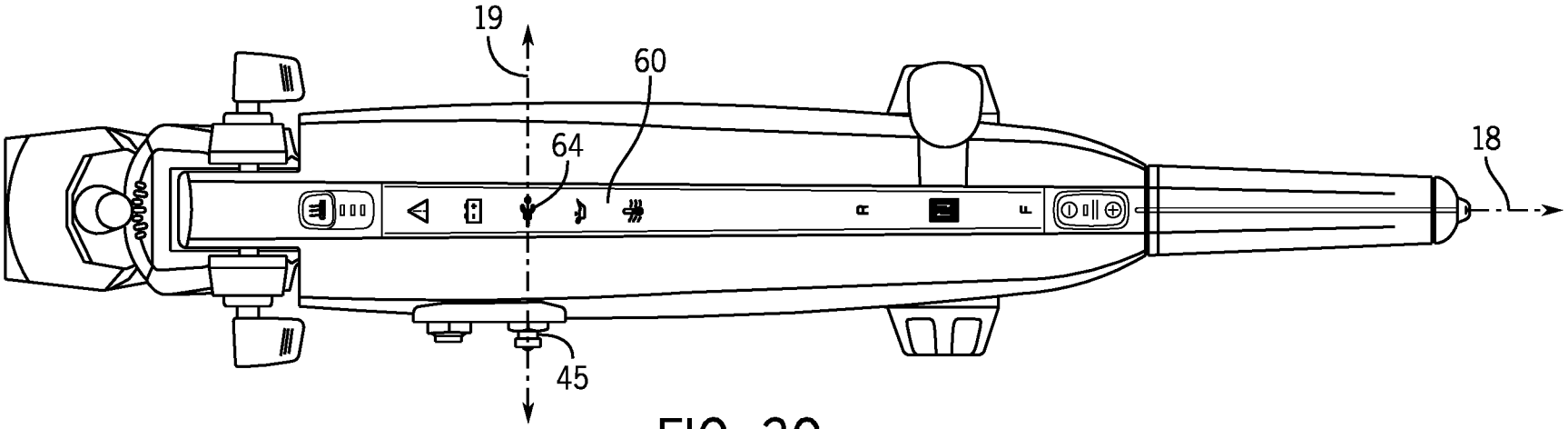

In one embodiment depicted in FIGS. 3A and 3C, the lanyard error icon 64 is positioned such that it visually aligns with the lanyard switch 45. As best illustrated in FIG. 3C, the lanyard error icon 64 may align with the lanyard switch 45 along an axis 19 that runs through the lanyard switch and perpendicular to the tiller axis 18. Thereby, the lanyard error icon 64 is visually noticeable to an operator trying to start the outboard marine drive 12 and is likely to be associated with the lanyard system.

Figure 4:
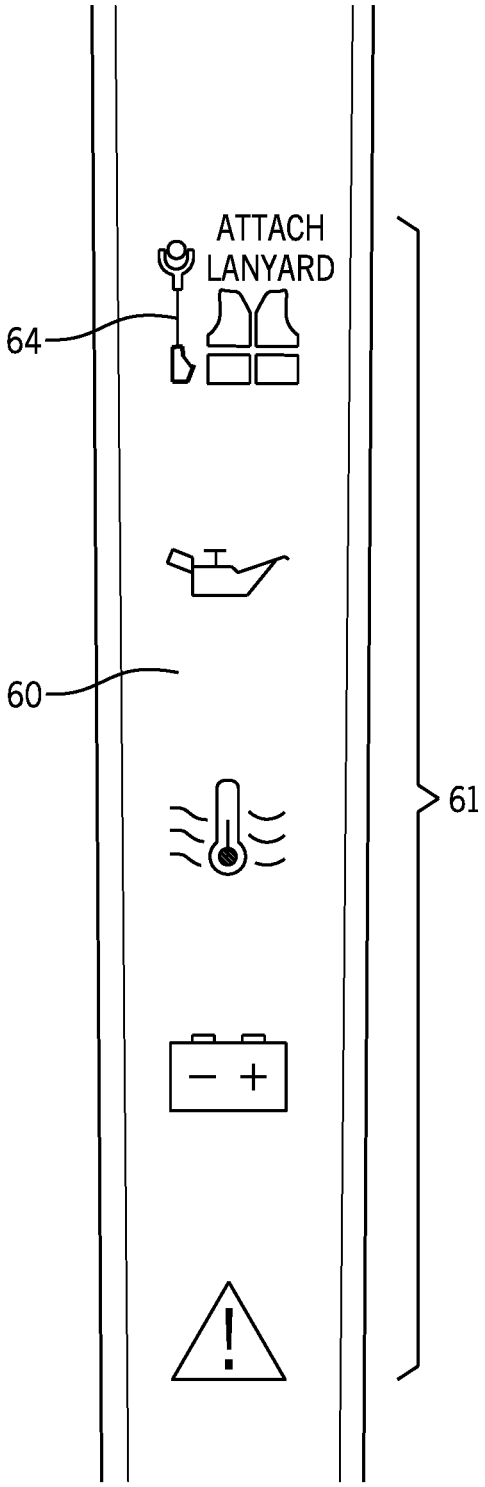
FIG. 4 depicts another exemplary embodiment of a display providing an illuminable lanyard error warning.

The lanyard error icon 64 may be designed to visually communicate to the operator that the lanyard clip 51 is not attached to the lanyard switch 45—i.e. to visually communicate or represent the problem in a simplistic graphic that can easily be recognized by the operator. FIGS. 3A-3C depict one exemplary embodiment of the lanyard error icon 64, which includes a depiction of a lanyard clip 64*a* detached from a visual representation of a lanyard switch 64*b*. FIG. 4 depicts another exemplary icon arrangement. In the depicted example, the lanyard error icon 64 includes the message "Attach Lanyard". Thus, the icon 64 in the example at FIG. 4 coveys a verbal instruction to the user to attach the lanyard, and also includes a visual depiction of the lanyard 50 along with a lifejacket. Additionally, in FIG. 4, the error icons 61 are arranged differently than in the foregoing embodiments, where the lanyard error icon 64 appears at the top of the display 60, closest to the second end 22 of the tiller 10. The other error icons in the series of error icons 61 on the display 60 are positioned, or aligned, along the tiller axis 18.

Figure 6:
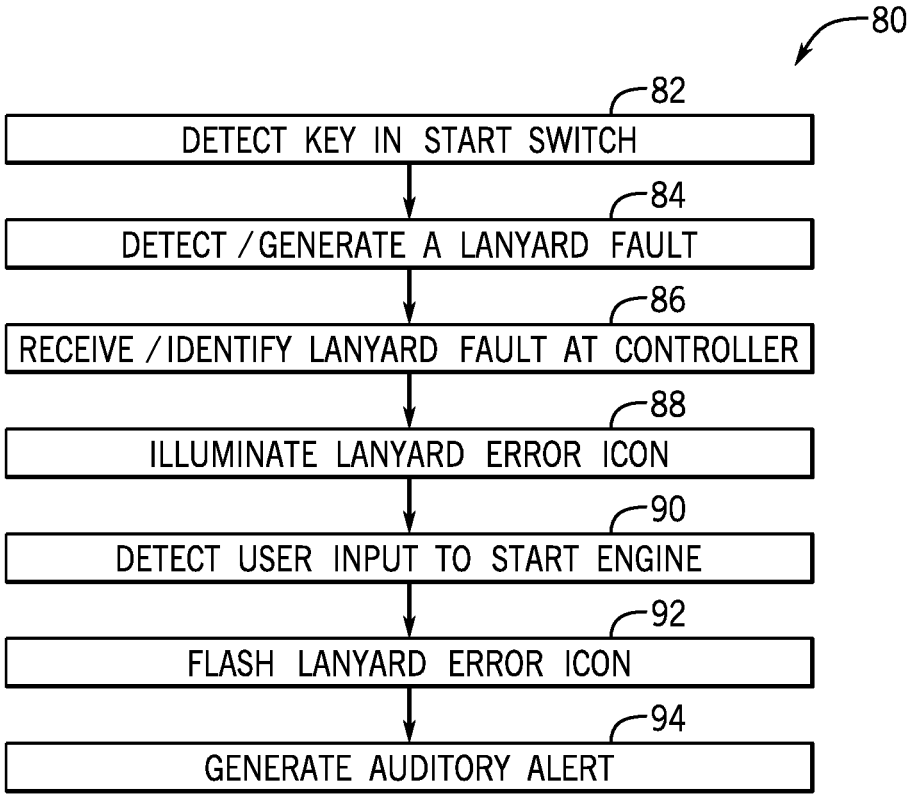
FIG. 6 is a flow chart demonstrating one embodiment of a method of controlling a tiller on an outboard marine drive.

FIG. 6 depicts one embodiment of a method 80 of controlling a tiller for an outboard marine drive. A key is detected in the start switch at step 82. A lanyard fault, or lack of a lanyard clip 51 connected to the lanyard switch 45, is detected and generated at step 84. For example, a sensor 46 may detect an open circuit at the lanyard switch 45. The lanyard fault is received and/or identified by the controller at step 86. For example, the controller 70 may receive a lanyard fault via the CAN bus 75. The lanyard error icon may then be illuminated at step 88. For example, the controller 70 may communicate with the illumination controller 72 to illuminate the LED 66 associated with the lanyard error icon 64. For example, the lanyard error icon may be illuminated with a constant illumination. Alternatively, the lanyard error icon 64 may be flashed, such as by turning on and off the respective LED 66*a*-66*d*.

The user input to start the engine is detected at step 90. For example, the controller 70 may receive input from the start switch 37 or a sensor 39 associated therewith indicating that the operator has turned the key 38 and/or that the key 38 is inserted in the start switch 37. Assuming the lanyard fault is still identified, then the controller may operate to flash the lanyard error icon at step 92, or otherwise change the illumination of the lanyard error icon. For example, if the lanyard error icon 64 was flashed at step 88, then the lanyard error icon may be flashed at a higher frequency at step 92. In certain embodiments, the lanyard error icon may be flashed for a predetermined period of time at step 92, or may be flashed a predetermined number of times, following detection of the user input at step 90. In certain embodiments, an auditory lanyard error alert may also be generated at step 94, such as by controlling the speaker element 77 or other sound-generating element on the tiller 10, in order to generate a sound alerting the operator to the error.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A tiller for an outboard marine drive, the tiller comprising:

a tiller body that is elongated along a tiller axis between a fixed end connected to an outboard marine drive and a distal end;

a lanyard switch on the tiller body, wherein the lanyard switch is configured to prevent operation of the outboard marine drive when a lanyard clip is not attached to the lanyard switch;

an illuminable lanyard error icon on the tiller body configured to visually communicate to a user that the lanyard clip is not attached to the lanyard switch;

a controller configured to:

illuminate the lanyard error icon in a first illumination upon detection of a key by a start switch and that the lanyard clip is not connected to the lanyard switch;

identify that an operator has provided user input to start the outboard marine drive;

identify that the lanyard clip is not connected to the lanyard switch; and generate a lanyard error alert on the tiller identifying that the lanyard clip is not connected to the lanyard switch, including controlling illumination of the lanyard error icon to illuminate the lanyard error icon differently than the first illumination.

2. The tiller of claim 1, wherein generating the lanyard error alert includes controlling illumination of the lanyard error icon so as to repeatedly flash the lanyard error icon on and off.

3. The tiller of claim 2, wherein the controller is configured to flash the lanyard error icon a predetermined number of times following receipt of the user input to start the outboard marine drive.

4. The tiller of claim 1, wherein the illuminable lanyard error icon is on a deadface display positioned along a top portion of the tiller body.

5. The tiller of claim 4, wherein the deadface display includes a series of separately illuminable error icons aligned along the tiller axis.

6. The tiller of claim 5, wherein the lanyard error icon is positioned such that it visually aligns with the lanyard switch on the tiller.

7. The tiller of claim 1, wherein the lanyard error icon depicts a lanyard clip.

8. The tiller of claim 1, further comprising a speaker element and a display on the tiller, wherein the controller is configured to generate the lanyard error alert by controlling the speaker element to generate an auditory lanyard error alert and controlling the display to generate a visual lanyard error alert.

9. The tiller of claim 1, wherein the controller is further configured to identify that the lanyard clip is not connected to the lanyard switch upon receipt of the lanyard error alert via a CAN bus.

10. The tiller of claim 1, further comprising an attachment strap having one end attached to the lanyard clip and an opposing end attachable to the operator.

11. A method of controlling a tiller for an outboard marine drive, the method comprising:

generating a lanyard fault, wherein the lanyard fault indicates that a lanyard clip is not attached to a lanyard switch;

detecting a key in an ignition switch on the tiller and then, based on the lanyard fault, illuminating a lanyard error icon in a first illumination to alert an operator that the lanyard clip is not connected to the lanyard switch;

detecting a user input on the tiller instructing start of the outboard marine drive;

identifying, at a controller, that the lanyard clip is not connected to the lanyard switch based on the lanyard fault; and illuminating the lanyard error icon differently than the first illumination to alert an operator that the lanyard clip is not connected to the lanyard switch.

12. The method of claim 11, wherein generating the lanyard error alert includes controlling illumination of the lanyard error icon so as to repeatedly flash the lanyard error icon on and off.

13. The method of claim 12, further comprising flashing the lanyard error icon a predetermined number of times following receipt of the user input instructing start of the outboard marine drive.

14. The method of claim 11, further comprising flashing the lanyard error icon following receipt of the user input instructing start of the outboard marine drive.

15. The method of claim 14, further comprising also generating an auditory lanyard error alert in conjunction with the display on the tiller following receipt of the user input instructing start of the outboard marine drive.

16. The method of claim 11, further comprising generating an auditory lanyard error alert in conjunction with the display on the tiller.

17. The method of claim 11, further comprising sensing that the lanyard switch is open and communicating a lanyard fault via a CAN bus.

* * * * *